United States Patent [19]

Lasier et al.

[11] Patent Number: 4,979,261

[45] Date of Patent: Dec. 25, 1990

[54] VARIABLE POSITION DOOR CLOSER

[75] Inventors: Thomas R. Lasier, Princeton; Andrew Current, Oglesby, both of Ill.

[73] Assignee: Schlage Lock Company, San Francisco, Calif.

[21] Appl. No.: 361,249

[22] Filed: Jun. 5, 1989

[51] Int. Cl.[5] ..... E05F 3/00

[52] U.S. Cl. ..... 16/62; 16/69; 16/64; 16/71; 16/79; 49/324; 49/340

[58] Field of Search ..... 16/62, 64, 69, 71, 79, 16/195, DIG. 9, DIG. 10; 292/262, DIG. 15; 49/324, 340

[56] References Cited

U.S. PATENT DOCUMENTS

| | | | |
|---|---|---|---|
| 605,836 | 6/1898 | Ashley | 16/64 |
| 734,658 | 7/1903 | Beauregard et al. | 16/69 |
| 1,526,395 | 2/1925 | Swanson | 16/64 |
| 1,605,256 | 11/1926 | McAboy | 16/79 |
| 4,744,125 | 5/1988 | Scheck et al. | 16/62 |

FOREIGN PATENT DOCUMENTS

| | | | |
|---|---|---|---|
| 7144 | 1/1977 | Japan | 16/79 |

*Primary Examiner*—Richard K. Seidel
*Assistant Examiner*—Edward A. Brown
*Attorney, Agent, or Firm*—Walter C. Vliet

[57] ABSTRACT

Disclosed is a door control device that automatically repositions the driving shaft of the door closer toward and away from the door pivot, as the door opens and closes, as a means of modifying and improving the force required to open and close the door. Movement is accomplished by a double ended driving shaft having a sprocket gear on one end which drivingly engages a track which in turn repositions the slide mounted door closer to more favorable positions as the door opens and closes.

8 Claims, 3 Drawing Sheets

VARIABLE POSITION DOOR CLOSER

BACKGROUND OF THE INVENTION

It is desirable to have a door closer which will produce sufficient force to reliably close and latch the door. In addition, upon opening, it should present a relatively uniform force from the closed position to the open position. In a door closer application there is a substantial geometry change from the point of attachment of the control arm on the door controller to the door frame track where the force is applied in going from the closed position to the open position. This is further complicated in that the force produced by the closer generally increases as the door opens because of internal spring rates in the closer. As a result there is considerable variation in the force necessary to open the door and conversely the force exerted by the closer in closing the door varies substantially over the range of door opening.

OBJECT OF THE INVENTION

It is an object of the present invention to produce a more uniform door closing and opening force over the range of operation.

It is a further object of this invention to obtain the results of a more uniform force by moving the location of the door closer relative to the door pivot point during the door opening and closing cycle.

It is yet a further object to obtain a door closer which produces relatively uniform door closing forces in a simple, reliable, economical and easy to install manner.

These and further objects are obtained in a door closer of the type having rotary output of a shaft connected to a control arm which accomplishes the automatic closing of a door, the improvement comprising: mounting the door closer on a slide means permitting translation of the door closer so as to change the relative distance of the rotary output shaft from the door pivot point and means associated with the rotary output of the door closer for effecting translation of the door closer on the slide means.

BRIEF DESCRIPTION OF THE DRAWINGS

Viewing FIGS. 1 through 4 from the right side of the page.

DESCRIPTION OF THE PREFERRED EMBODIMENT

Figure 2:
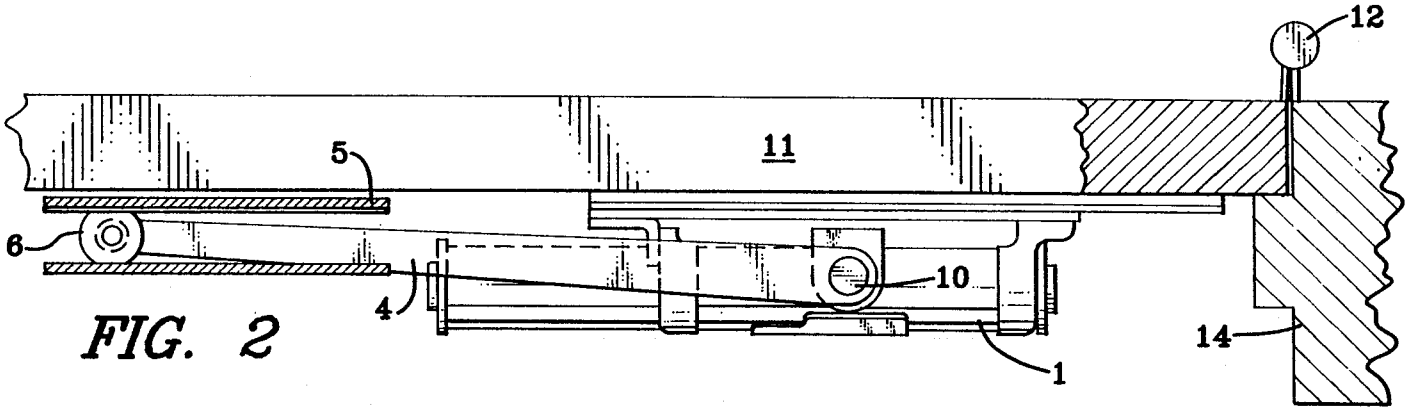
FIG. 2 shows a top view of the door closer.
Figure 1:
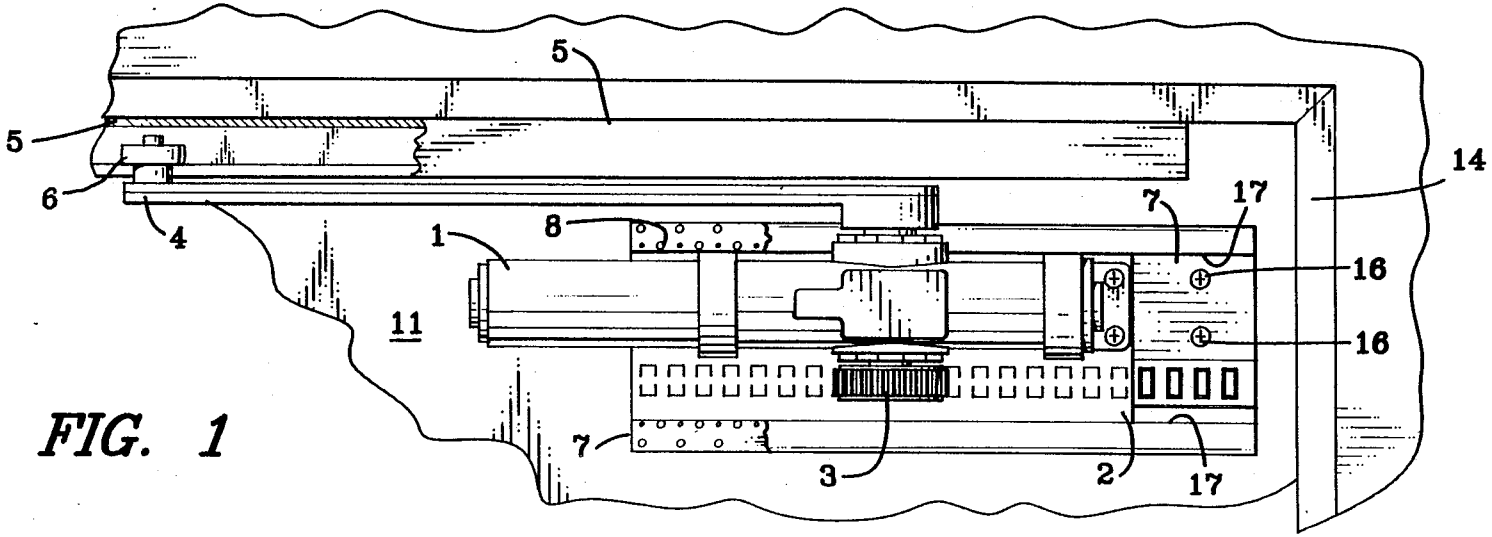
FIG. 1 shows a plan or front view of a door closer according to the present invention mounted on a door having the output of its control arm applied to the door jamb in a track.
Figure 3:
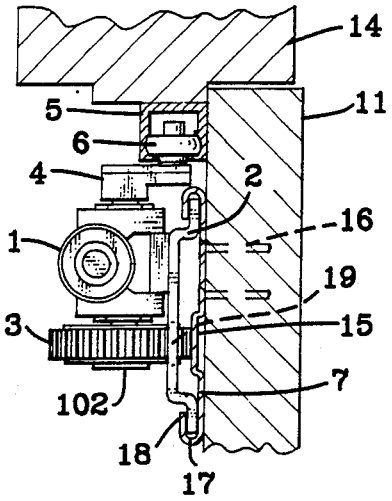
FIG. 3 shows an end view of the door closer.
Figure 4:
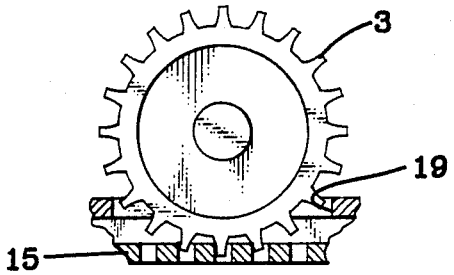
FIG. 4 is a partial bottom view showing the output pinion and track according to the present invention utilized to effect translation of the door closer.

FIGS. 1 through 4 show a door closer 1 which may be of a type well-known in the art having its output force on a rotary shaft. The door closer is provided with a double ended rotary driving shaft 10. Attached to the top end of the shaft is a single arm 4 whose outboard end is slidably engaged with track 5 through track roller 6. Track 5 is firmly anchored to the header of the door frame. The door closer 1 in turn is shown mounted to a conventional door 11 which opens about a hinge point 12. Hinge 12 is attached to both the door 11 and the door jamb 14.

A toothed pinion gear or sprocket 3 is attached to the other end of the drive shaft 10 and engages a rack 15 formed in a door plate 7 which is in turn firmly attached to the door 11 by means of screws 16. Door plate 7 is formed of sheet metal in the preferred embodiment and has each end bent to form a retaining lip 17 which encloses a U shaped bearing 18 best seen in FIG. 3. The bearing 18 may be made of a nonstick material such as Teflon or be a ball type bearing as shown having a plurality of balls 8 which reduce sliding friction. The bearing 18 in turn slidingly engages a slide plate mechanism 2 on which the door closer assembly 1 is mounted. The sprocket 3 engages the rack 15 formed in the door plate through a rectangular hole 19 cut in the slide plate 2.

It will now be apparent to one skilled in the art that as the door moves about its hinge point 12 and as roller 6 is slidably captured in track 5, the outboard end of arm 4 is restrained from rotational movement, resulting in rotation of the drive shaft of the closer. This rotation of the drive shaft, common to both arm 4 and toothed wheel 3, turns pinion gear 3, translating it along rack 15, shifting the position of sliding mechanism 2 and attached door closer 1 thereby repositioning the driving shaft of the door closer, with reference to pivot 12.

It is this directed and uniform movement of closer 1 toward the pivot point, during the opening swing of the door, that produces a more desirable uniform opening power curve. Conversely, as the door is closed by closer 1, the drive shaft is directed away from the pivot point back to its original location at the door closed position, thereby favorably increasing the leverage ratio of the closer 1.

For the configuration shown it should be appreciated that as the door opens the door closer is driven closer to the door hinge. The object of the present invention thereby being accomplished by moving the position of the door closer as the door opens or closes.

Figure 5:
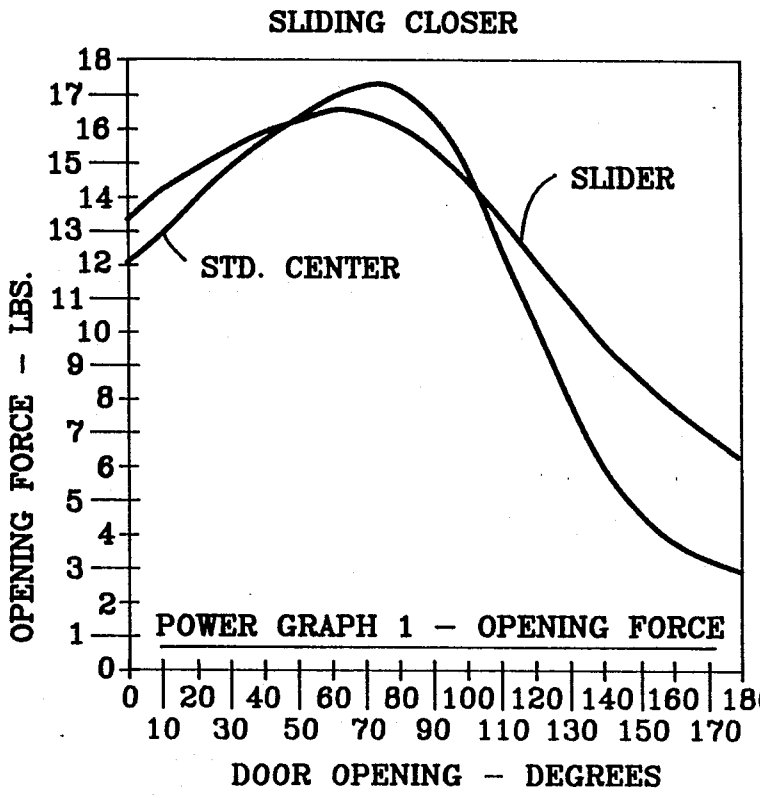
FIG. 5 shows a power graph of the opening force required with the present invention as compared to a fixed mounted closer of the same type.
Figure 6:
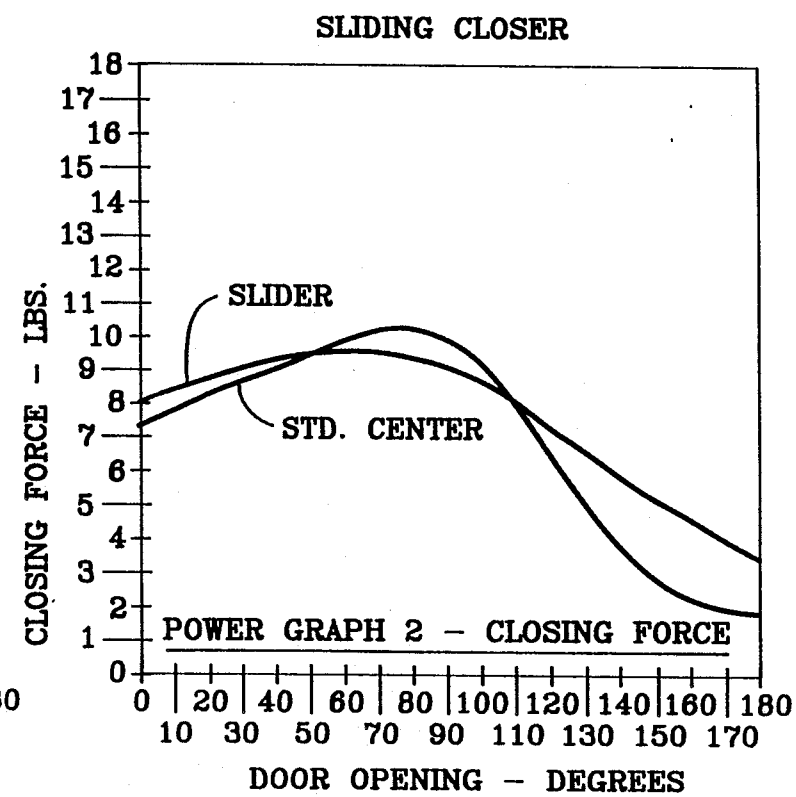
FIG. 6 shows a power graph for the closing force of a closer according to the present invention as compared to a standard mounted closer of the same type.

This controlled change in the geometry of the force diagram is especially significant in the case of a single arm closer and track installation. As shown in FIGS. 5 and 6, as the distance from the centerline of the closer shaft to the door pivot point is decreased, the opening and closing force provided by the closer is also decreased thereby flattening the power curves.

Referring to power graph No. 1 in FIG. 5, the opening force curves (pounds, measured at 30" from the pivot center) of both a standard door closer and the sliding center door closer defined in this disclosure are shown. The power curve of the standard (fixed center) door closer shows a rapid increase in force up to about 80° door opening and then a precipitous drop in force beyond that 80° point. The power curve of the slider closer shows a more moderate increase in force, peaking at about 65° of door opening, with a moderated force curve beyond that point.

Power graph 2 (FIG. 6) represents the closing forces of the two units described above, and as expected, the curves are basically parallel to the opening forces shown on graph No. 1, again showing the leveling or advantageous moderation of the power curve produced by the sliding type closer mounting.

Figure 7:
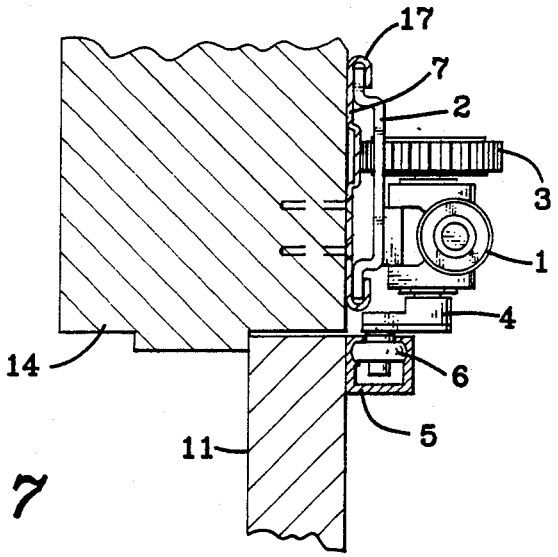
FIG. 7 shows an alternative embodiment having the door closer mounted on a door jamb having the output of its control arm applied to the door in a track.

Although drawings, FIGS. 1-4, depict the closer assembly mounted on the push side of a door, with the track on the push side of the door frame; it will be recognized that the door closer and track may, if desired, also be mounted on the pull side of the door. Further, the closer can be fastened to either side of the head frame with the track mounted on the corresponding side cf the door as shown in FIG. 7. Or, in some instances, the track can be recessed (mortised) in the head frame or in the top of the door.

Obviously, increasing or decreasing the diameter of the toothed wheel will accelerate or decelerate the movement of the closer, thereby affecting the power curve.

A natural extension of this unique arrangement would be to modify the toothed wheel from a truly circular part to one having an elliptical or spiral perimeter mating with a complimentary sloped rack. In fact, the conjunction points of the toothed wheel and mating rack can be modified to produce any degree of nonuniform translation of the closer that will satisfy the requirements of any nonstandard set of power curves.

Having described our invention in terms of a preferred embodiment, numerous modifications, including those suggested and others, will occur to those skilled in the art. We therefore do not wish to be limited in the scope of our invention except as claimed:

We claim:

1. A Door Closer Assembly of the type having rotary output on a shaft connected to a control arm which accomplishes the automatic closing of a door, the improvement comprising: means for mounting the door closer on a slide means for permitting translation of said door closer on said slide means and for changing the relative distance of the rotary output shaft from a door pivot point and means associated with said rotary output shaft of said door closer for effecting said translation.

2. A Door Closer Assembly according to claim 1 wherein: said slide means comprises a mounting plate having guide bearing means for accepting a slide plate to accomplish linear translation of said slide plate with a minimum of friction.

3. A Door Closer Assembly according to claim 2 wherein: said bearing means of said slide means further comprises linear ball bearing elements engaging at least one side of said slide plate.

4. A Door Closer Assembly according to claim 2 wherein: said mounting plate is provided with a rack and said means for effecting translation comprises in combination said rack in contact with a pinion gear mounted for rotation on one end of said shaft means, and said control arm is mounted at the other end of said shaft opposite said pinion gear.

5. A Door Closer Assembly according to claim 1 wherein: said means associated with said rotary output shaft for effecting translation comprises a rack and pinion assembly for cooperatively driving a slide plate in a linear direction towards and away from a door hinge.

6. A Door Closer Assembly according to claim 5 wherein: said slide plate and a mounting plate are mounted to a door and said control arm is slidingly engaged with a track mounted in or on a door jamb.

7. A Door Closer Assembly according to claim 5 wherein: said rack and pinion assembly are of a nonlinear type that vary the rate of translation of the door closer toward and away from the door hinge depending on the door position.

8. A Door Closer Assembly according to claim 5 wherein: said slide plate and a mounting plate are mounted on a door jamb and said control arm is slidingly engaged with a track mounted in or on a door.

* * * * *